United States Patent [19]

Baker et al.

[11] 4,225,283

[45] Sep. 30, 1980

[54] BACKHOE BUCKET QUICK COUPLING

[75] Inventors: Joe L. Baker, Carman, Ill.; Lanny J. Roth, Burlington, Iowa

[73] Assignee: J. I. Case Company, Racine, Wis.

[21] Appl. No.: 12,270

[22] Filed: Feb. 15, 1979

[51] Int. Cl.[3] ..... E02F 3/70

[52] U.S. Cl. ..... 414/723; 74/520; 172/272

[58] Field of Search ..... 414/686, 723, 724; 280/477, 478 R, 478 A, 478 B; 172/272, 273; 37/117.5; 74/520

[56] References Cited

U.S. PATENT DOCUMENTS

| | | | |
|---|---|---|---|
| 2,574,281 | 11/1951 | Olson | 74/520 X |
| 3,794,195 | 2/1974 | Clevenger et al. | 414/723 |
| 3,818,551 | 6/1974 | Coughran, Jr. | 414/723 X |
| 3,935,953 | 2/1976 | Stedman | 414/723 X |
| 4,116,347 | 9/1978 | Uchida | 414/723 |

*Primary Examiner*—Stephen G. Kunin
*Assistant Examiner*—T. L. Siemens
*Attorney, Agent, or Firm*—Cullen, Sloman, Cantor, Grauer, Scott & Rutherford

[57] ABSTRACT

An attaching and release mechanism is provided for coupling a material handling bucket to the free end of a scoop arm extending from a loader or backhoe. A universal bucket mounting linkage is pivotally mounted to the loader scoop arm and readily receives various types and sizes of buckets. The bucket mounting linkage has a four-bar configuration with hook portions adapted for engagement with mating projections on the bucket. Over-center linkage, pivotally attached to one end of the bucket mounting linkage, provides locking engagement or disengagement between the hook portions and the mating projections on the bucket. To latch the bucket on the loader scoop arm, the hook portions and over-center linkage are aligned with the complementary mounting structure on the bucket, and the over-center linkage is pushed over-center which causes the bucket mounting linkage to lock against the mounting structure on the bucket to thereby couple the bucket and loader scoop arm.

3 Claims, 5 Drawing Figures

BACKHOE BUCKET QUICK COUPLING

BACKGROUND OF THE INVENTION

The present invention relates to an apparatus for attaching implements to the free end of a tractor loader boom and more particularly to an improved and simplified quick attachment and release device for attaching buckets or the like to a loader or backhoe scoop arm.

It is known to provide backhoes or similar types of earthworking machines with different sizes and types of material handling implements or buckets to perform numerous working operations. Changing from one bucket to another is a problem because of the time and labor expended in the changeover. The buckets are heavy and awkward to manipulate and many times special tools are required to make the changeover. It is an object of this invention to provide a quick-attaching and release mechanism for easily coupling and releasing different buckets to the same loader boom structure.

In prior art backhoes, the buckets are typically bolted to the actuating arms of the loader scoop arm during periods of use. Since the buckets are heavy items, a great deal of time and effort is required to release the bucket from the scoop arm for repairs to the bucket or the actuating arms. Further, after a period of use, dirt and corrosion often render removal of the bucket from the loader quite difficult. The problems encountered by using bolts and nuts or pins as the attachment and release mechanisms for loader buckets has resulted in reduced flexibility in using a loader in connection with other buckets and undesirable features in performing maintenance on the bucket and loader.

The prior art semi-automatic devices for attaching and releasing implements on loaders have eliminated many of the problems associated with the use of bolts and nuts or pins. However, due to the design of such prior art devices, fatigue and fracture continue to be a problem, and dirt often causes the complex operative elements of the attachment and release devices to become jammed. Further, the latching devices are often activated from the vehicle's operator station which necessitates an additional operator action. Thus, several of the problems associated with manual attachment devices also exist when semi-automatic quick attachment and release devices of the prior art are utilized.

These disadvantages of present quick attaching mechanisms have resulted in the present quick coupling device for attaching a material handling implement or bucket to a loader's boom structure.

SUMMARY OF THE INVENTION

In accordance with the present invention, the improved attachment and release mechanism permits various buckets to be used with the same scoop arm, and it permits a bucket to be attached or released from the scoop arm in a minimum of time and with a minimum of effort.

It is an object of the invention to provide a quick attaching and release mechanism having a universal bucket mounting linkage which is pivotally mounted to the loader's scoop arm and which readily receives various types and sizes of buckets. The bucket mounting linkage has a four-bar configuration, and it includes bucket mounting arms which are adapted for engagement with mating projections and surfaces on the bucket. One end of each bucket mounting arm has a hook portion which cooperatively locks around disk-like lateral projections mounted on the bucket. An over-center linkage mechanism is pivotally mounted on the other end of the bucket mounting arms for engagement with complementary structure on the bucket. In a latched position, the longitudinal extent of each bucket mounting arm is forced into locking engagement with complementary bucket support surfaces to thereby stabilize the bucket as well as forming a quick and reliable coupled connection between the bucket and loader scoop arm.

A further feature of the present invention resides in the provision of an over-center linkage mechanism for causing locking engagement or disengagement between the bucket mounting arms and the mating surfaces on the bucket. The over-center linkage is a four-bar structure having a first pair of downwardly extending links fixed to one end of the bucket mounting arms. A locking lever is pivotally attached between the first pair of downwardly extending links, and it is pivoted to snap the mechanism over center for locking or unlocking. The locking lever is pivotally attached to a second pair of links and pivotal movement of the locking lever lifts or lowers the second pair of links when the mechanism is snapped over center. A saddle block extends between and is fixed to the free ends of the second pair of links, and a recess in the saddle block mates with an adjustable bolt mounted on the bucket. The locking lever is pivoted in one direction to lock the bucket and loader scoop arm such that the bucket mounting arms are drawn down against the mating bucket surfaces, or it is pivoted in an opposite direction to release the bucket from the bucket mounting arms.

Other advantages and meritorious features of the quick attachment and release construction of the present invention will be more fully understood from the following description of the preferred embodiment, the appended claims, and the drawings, a brief description of which follows.

DESCRIPTION OF THE PREFERRED EMBODIMENT

Figure 2:
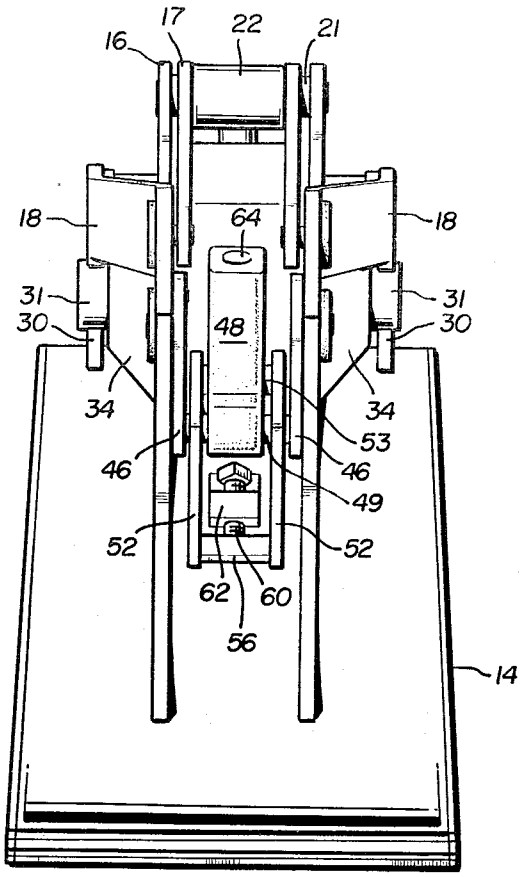
FIG. 2 is a front elevational view illustrating the attachment mechanism in its latched position.
Figure 1:
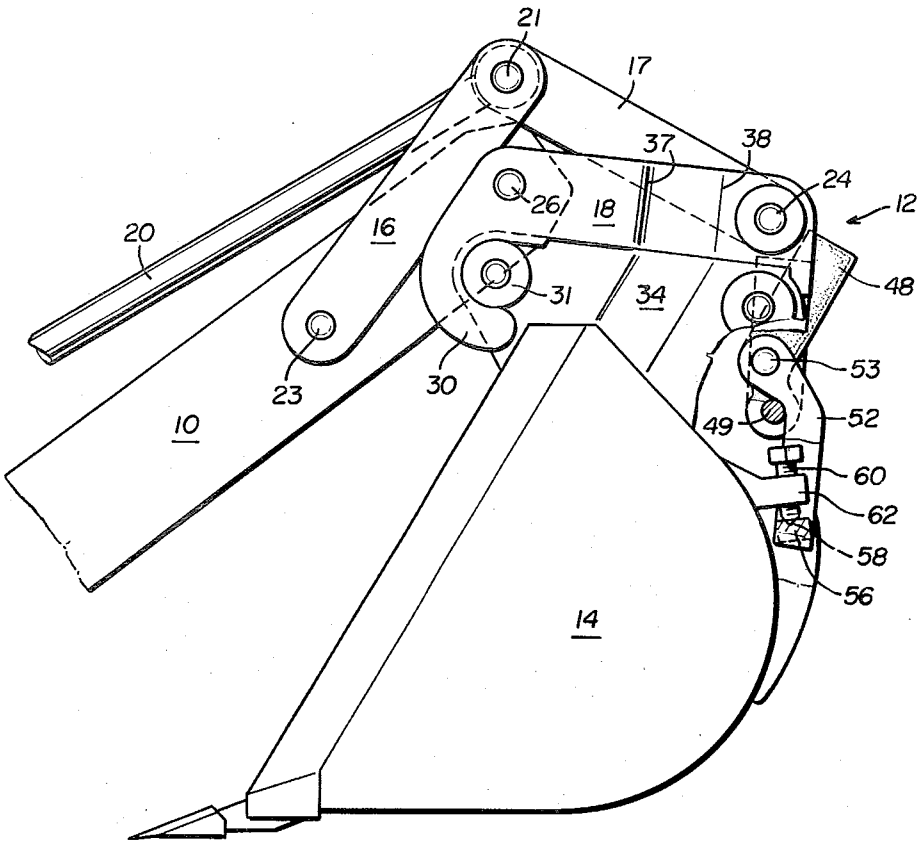
FIG. 1 is a side elevational view of a loader scoop arm and bucket connected by the attachment and release device of the present invention with a portion cut-away for easier viewing.

A tractor mounted backhoe having an extensible dipper stick 10 and coupling mechanism 12 according to the present invention is illustrated in FIGS. 1–5. The backhoe assembly includes a rearwardly projecting boom (not shown) to which is connected the dipper stick 10 in a conventional manner. A bucket assembly 14 is pivotally attached to the end of the dipper stick by the quick attachment and release device 12 of the present invention.

The quick attaching mechanism 12 includes a four-bar bucket mounting linkage pivotally mounted to the dipper stick 10 to readily attach various types and sizes of buckets. The attaching mechanism also includes an over-center linkage mechanism for causing locking engagement or disengagement between the bucket mounting linkage and mating surfaces on the bucket. The mounting linkage is universal in that it may be used to attach various sizes and types of buckets.

The four-bar bucket mounting linkage, for pivotally connecting the bucket to the dipper stick, includes dipper stick links 16, push-pull links 17, bucket mounting arms 18, and part of the dipper stick between links 16 and arms 18. Piston rod 20 of a hydraulically actuated cylinder (not shown) is attached at its eye end 22 to one corner of the four-bar linkage by pin 21. Extension and retraction of the hydraulic cylinder causes the bucket assembly to pivot toward and away from dipper stick 10 thereby permitting the backhoe bucket to dig or dump.

Pin 21 pivotally connects one end of links 16, links 17 and piston rod 20. Links 16 are pivotally attached at their other ends to dipper stick 10 by pins 23. Push-pull links 17 are pivotally connected to bucket mounting arms 18 by pins 24. Bucket mounting arms 18 are pivotally attached to dipper stick 10 by pin 26. Thus, the four-bar configuration for coupling bucket 14 includes links 16 and 17, bucket mounting arms 18, and that portion of dipper stock 10 between pins 23 and 26.

The bucket mounting arms 18 which form part of the present invention, include hook portions 30 which fit around and mate with disk-like projections 31 formed on the bucket mounting brackets 34. Each bucket mounting arm hook portion is spaced outwardly from dipper stick 10 by bearing sleeve 35 and the width of bucket mounting bracket 34. The bucket mounting arms 18 are bent at bend lines 37 and 38, and the ends of arms 18, opposite the hook portions 30, are spaced relatively close together for connection with push-pull links 17. The bent contour of the bucket mounting arms 18 conforms with the complementary contour of bucket mounting brackets 34 for locking engagement when the bucket is latched. Arcuate abutment surfaces 42 on mounting arms 18 also mate with complementary arcuate surfaces on bucket mounting brackets 34 when the bucket is coupled.

Figures 3, 4, 5:
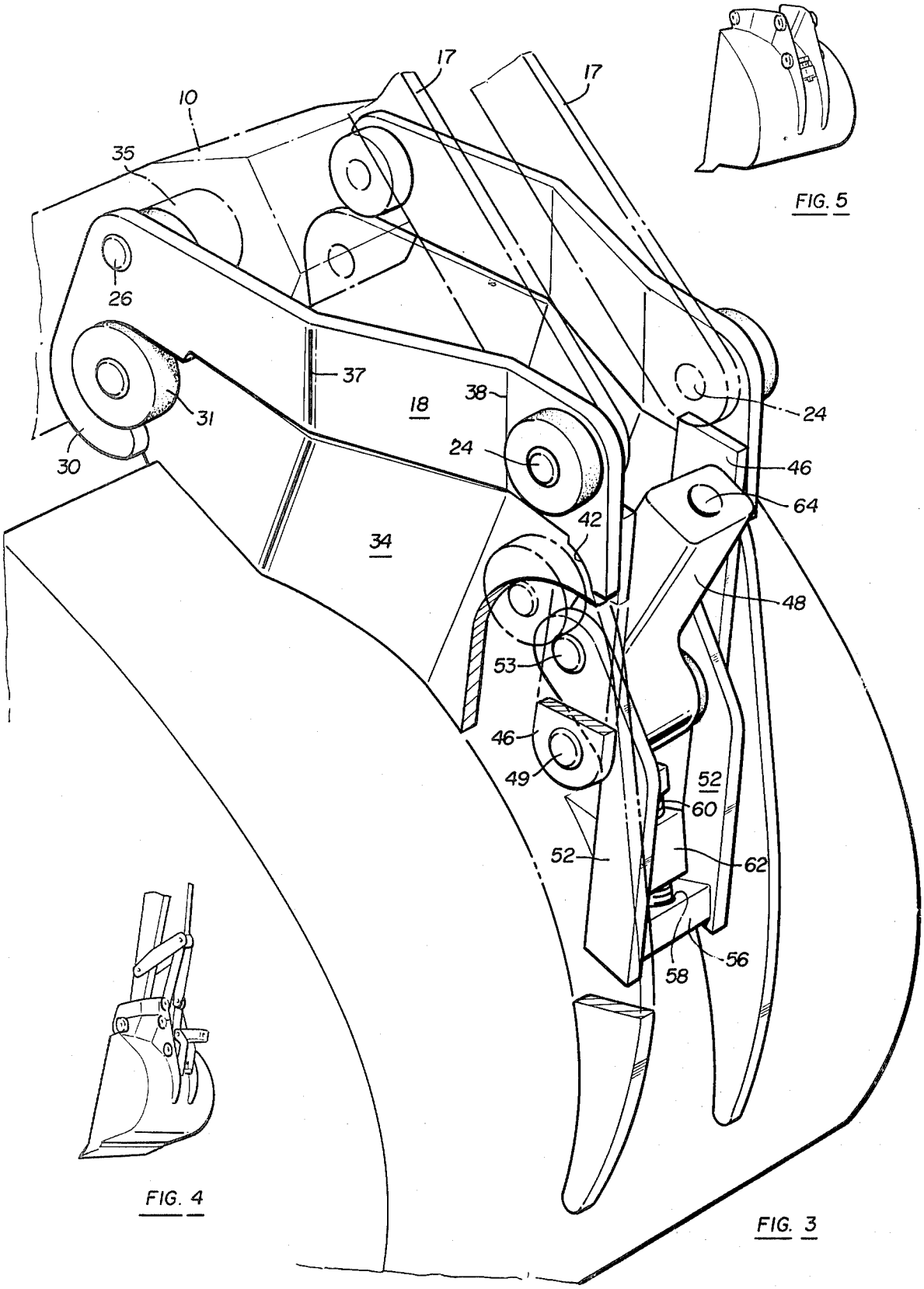
FIG. 3 is a perspective view further illustrating the attachment mechanism in its latched position with portions cut away for easier viewing.
FIG. 4 is a perspective view of the attachment and release mechanism in its unlatched position.
FIG. 5 is a perspective view of the bucket disconnected from the loader scoop arm.

The quick attachment and release mechanism 12 of the present invention permits a simplified bucket assembly construction. Referring to FIGS. 3 and 5, the bucket includes spaced apart, upstanding bucket mounting brackets 34 which have disk-like projections 31 at one end for complementary engagement with the hook portions 30 of the bucket mounting arms 18. The upstanding bucket mounting brackets 34 sit directly beneath and have a contour which follows the contour of the mounting arms 18 so that the line of contact between arms 18 and brackets 34 aids in stabilizing bucket 14 when it is coupled to the dipper stick 10. Thus, the dipper stick 10 can be attached or released quickly to various types and sizes of buckets by using the simplified attachment and release mechanism 12 in conjunction with the bucket mounting brackets 34.

The bucket 14 is locked to the bucket mounting linkage by an over-center release mechanism attached to the bucket mounting arms 18. The over-center release mechanism includes downwardly extending links 46 fixed at one end to the bucket mounting arms 18. Lever arm 48 is pivotally attached between the downwardly extending links 46 by pin 49. A second pair of links 52 are pivotally attached to lever arm 48 by pivot pin 53 above its bent portion. A saddle block 56 extends between and is fixed to links 52. The saddle block 56 has a recess 58 which mates with adjustable bolt 60 mounted on bucket 14 in lug 62. The lever arm 48 is rotated from its latched position illustrated in FIGS. 1–3 to an unlatched position by inserting a bar (not shown) in hole 64 of the lever arm 48 and rotating it clockwise approximately 90° to the position shown in FIG. 4.

To couple the bucket assembly 14 to the backhoe dipper stick 10, the operator positions the dipper stick such that the hook portions 30 are fitted around disk-like projections 31, and the adjustable bolt 60 is fitted into recess 58 of saddle block 56. The lever arm 48 must be pivoted approximately 90° clockwise from the position of FIGS. 1–3 to the position illustrated in FIG. 4 to lower links 52 sufficiently so that the adjustment bolt 60 can be fitted into recess 58 to ready the assembly for latching. The bucket is ready for latching when the mounting arms 18 are sitting directly above and in contact with the upper surface of bucket mounting brackets 34 as illustrated in FIG. 3. Latching is completed by inserting a bar in hole 64 of lever arm 48 and turning it counter-clockwise. This causes the lever arm 48 to snap over center and pull upwardly on links 52 thereby locking the bucket mounting arms 18 to the bucket mounting brackets 34 at hook portions 30 and along the line of contact between arms 18 and brackets 34. To increase or decrease the locking action, the adjustable bolt 60 is turned appropriately.

To uncouple the bucket from the dipper stick 10, the lever arm 48 is pivoted clockwise back over-center to disengage the adjustable bolt 60 and saddle block 56 as illustrated in FIG. 4 at which time the mounting arms 18 may be tilted to move the hook portions 30 from the disk-like projections 31. Thus, the present quick attachment and release mechanism of the present invention allows the operator to quickly and easily couple and uncouple buckets to the dipper stick 10 in a simple manner.

It will be apparent to those skilled in the art that the foregoing disclosure is exemplary in nature rather than limiting, the invention being limited only by the appended claims.

We claim:

1. An attachment and release device for attaching an implement to a loader scoop arm comprising:

(a) an universal implement mounting linkage pivotally mounted to one end of said scoop arm for receiving various types and sizes of implements;

(b) said linkage having a generally four-bar configuration including implement mounting arms;

(c) said mounting arms being pivotally mounted at one of their ends to said scoop arm, each said mounting arm having a hook-like portion;

(d) an over-center mechanism mounted between the other ends of said mounting arms, a locking lever pivotally mounted to said over-center mechanism;

(e) upstanding brackets mounted on said implement said brackets having mating surfaces for locking engagement with said implement mounting arms;

(f) said hook-portons on said mounting arms engaging lateral projections mounted on said implement brackets and said over-center mechanism engaging locking means mounted on said implement during latching of said implement to said mounting linkage; and (g) said locking lever being pivoted in a first direction wherein the longitudinal extent of each mounting arm is drawn down against the mating surfaces and projections on said implement brackets to lock said implement to said mounting linkage and said locking lever being pivoted in a second direction to release said implement from said mounting linkage.

2. The attachment and release device as defined in claim 1 wherein said mounting linkage includes first links pivotally connected to said scoop arm at one of their ends, second links pivotally connected at one of their ends to said mounting arms, said first and second links being pivotally connected together at their other ends, a piston-cylinder mounted to the pivotal connection between said first and second links for actuating said mounting linkage thereby causing said implement to pivot on said scoop arm.

3. The attachment and release device as defined in claim 1 wherein said over-center mechanism is a four bar structure having a first pair of downwardly extending arms, each downwardly extending arm being fixed to a respective mounting arm, said locking lever being pivotally mounted between said downwardly extending arms, a second pair of arms pivotally attached at one of their ends to said locking lever, said second pair of arms moving upwardly and downwardly as said locking lever pivots, a saddle block extending between and being fixed to the other ends of said second pair of arms, said saddle block having a recess which mates with said locking means mounted on said implement when said implement is latched to said mounting linkage.

* * * * *